United States Patent [19]

Miskiewicz

[11] Patent Number: 4,656,677

[45] Date of Patent: Apr. 14, 1987

[54] WATER-CLOSET VALVE

[76] Inventor: Leonard A. Miskiewicz, 219 Sprucewood St., Pittsburgh, Pa. 15210

[21] Appl. No.: 791,107

[22] Filed: Oct. 24, 1985

[51] Int. Cl.[4] ..... E03D 1/35

[52] U.S. Cl. ..... 4/395; 4/356; 4/378; 4/403; 4/404

[58] Field of Search ..... 4/395, 403, 404, 378, 4/413, 414

[56] References Cited

U.S. PATENT DOCUMENTS

| | | | |
|---|---|---|---|
| 1,577,728 | 3/1926 | Katzin | 4/403 |
| 1,904,898 | 4/1933 | Kennedy | 4/378 X |
| 2,117,629 | 5/1938 | Rosanthal | 4/404 |
| 2,155,902 | 4/1939 | Kass | 4/403 |
| 2,589,110 | 3/1952 | Meltsner | 4/404 |
| 3,086,218 | 4/1963 | Gross | 4/404 X |
| 4,385,406 | 5/1983 | Miskiewicz | 4/356 |

*Primary Examiner*—Henry K. Artis

*Attorney, Agent, or Firm*—Thomas H. Murray; Clifford A. Poff

[57] ABSTRACT

Savings in water consumption are obtained and problems with leakage are avoided by using a water-closet valve which is made of flexible air- and water-tight material and has not only a generally frustoconical seat-engaging portion provided with a pair of circumferential rings or protuberances so as to permit the formation of a double seal but also an interior hollow portion such that towards the end of a flushing operation there is produced within the valve member a partial vacuum which creates a thrust force to perfect the sealing of the valve member within its seat.

3 Claims, 3 Drawing Figures

WATER-CLOSET VALVE

BACKGROUND OF THE INVENTION

1. Field of the Invention

This invention relates to a water-closet or toilet equipment, and in particular, it relates to the providing of one particular part of the apparatus which comprises such equipment, namely, the particular part or member which is located within the flush tank in the vicinity of its bottom and engages, with a bottom portion of said part, the opening or conduit (usually a member which is, in outline, generally cylindrical) through which water contained in the flush tank is permitted to pass by gravitational flow to the bowl of the toilet or water closet.

2. Description of the Prior Art

Usually, the above-mentioned part presents, towards the top of the cylindrical conduit through which the water contained in the flush tank is permitted to exit by gravitational flow to the bowl of the toilet, a surface which is hemispherical or frustroconical and closed in its bottom. As those skilled in the arts of the construction and the use of such equipment are well aware, no more than this is required in order to obtain an apparatus which is operable, affording, when the operating handle of the water closet is turned or the chain is pulled to take the part in question out of contact with the top of the conduit member in which it usually sits, a suitable downward rush of water under the influence of gravity through the conduit. The conduit is, at times between flushing operations, stoppered by the part or element in question.

Those skilled in the art should also be well aware, for example, from U.S. Pat. No. 1,904,898, that there has hitherto been known in the art the use of a valve member of frustroconical shape "preferably made of bronze or other rust-proof sheet metal", with the valve shown in the patent being one having a hollow interior and an open bottom.

The prior art contains, moreover, my earlier U.S. Pat. No. 4,385,406, which discloses a watercloset valve having two distinct seals located in a generally frustroconical portion of a rubber watercloset valve member which is adapted to be received within a matching frustroconical seat member located in the ceramic bottom of the flush tank of a water closet. The device there shown preferably relies upon circular 0-ring seals instead of having the parts of the valve that bring about the effect of the double seal comprises a pair of rubber ridges formed integrally in the rubber valve member. Moreover, the valve member there shown lacks the capability of affording the effect of causing the development of a partial vacuum within the hollow interior of the valve member as a result of the passage of water past the valve during the flushing action, and as a result, it does not provide any water-saving, accelerated closing action.

SUMMARY OF THE INVENTION

Savings in water consumption are obtained and problems with leakage are avoided by using a water-closet valve which is made of flexible air- and water-tight material and has not only a generally frustroconical seat-engaging portion provided with a pair of circumferential rings or protuberances so as to permit the formation of a double seal but also an interior hollow portion such that towards the end of a flushing operation there is produced within the valve member a partial vacuum which creates a thrust force to perfect the sealing of the valve member within its seat.

DESCRIPTION OF THE DRAWINGS

A complete understanding of the invention may be obtained from the foregoing and following description thereof, taken in conjunction with the appended drawings, in which.

DESCRIPTION OF THE PREFERRED EMBODIMENTS

Figure 2:
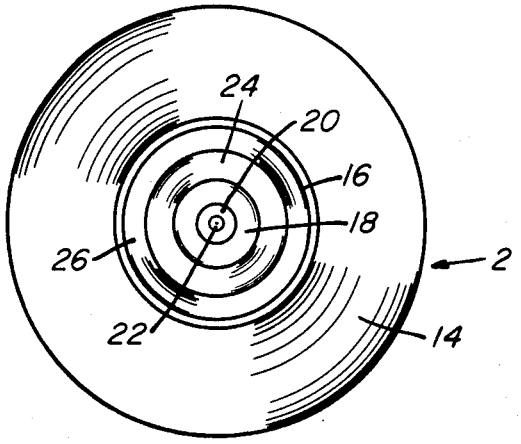
FIG. 2 is a top view of the valve member of FIG. 1.

In the drawings, there is shown one embodiment of a valve 2 which is conformed and constructed in accordance with the present invention.

Figure 1:
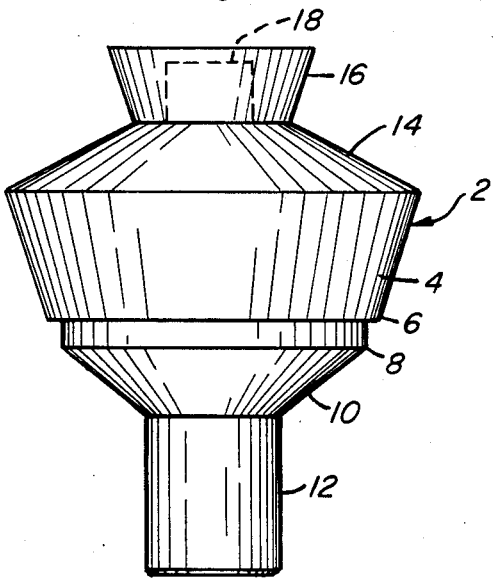
FIG. 1 depicts a front elevational view of a water-closet valve member in accordance with the present invention.

As can be seen from FIG. 1, the valve 2 has a first frustroconical portion 4 which tapers inwardly toward its bottom, the valve member 2 being so shaped as to provide first and second circumferential protuberances 6 and 8, respectively, integrally formed within the valve member 2, and therebelow, a second frustroconical portion 10 which is tapered inwardly somewhat more sharply and joined to a generally cylindrical portion 12. Above the first frustroconical portion 4, there is an inwardly tapered frustroconical portion 14, which is surmounted by still a further frustroconical portion 16 which is flared outwardly as one approaches the top of the valve in question.

As can be seen from FIG. 2, the valve 2 has, when seen from the top, a generally cylindrical collar member 18, within which there is set snugly therein a bushing member 20, made of inflexible material such as metal, and having therein a central threaded opening 22, by means of which the valve 2 may be attached, in a manner familiar to those skilled in the art, to a rod-like member (not shown); those skilled in the art are familiar with the means for guiding such rod-like member for vertical motion up and down and for mechanically causing the rod to be raised to initiate a flushing action, as well as the usual float-actuated, water-flow valve which operates to bring the liquid level in the flush tank to a desired value. In FIG. 2, the above-mentioned collar member 18 sits within a well, the bottom surface of which is designated 24, and the outside of which has a sloping side wall surface 26.

Figure 3:
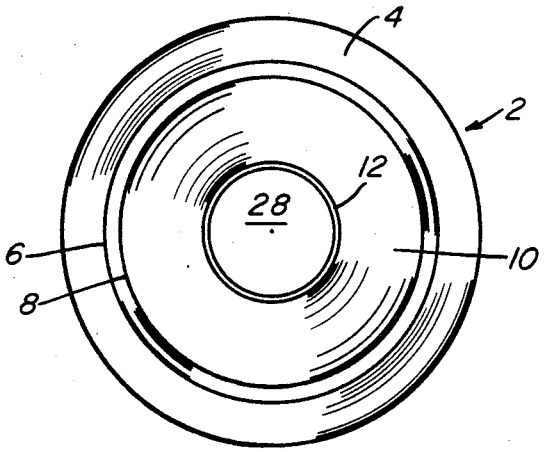
FIG. 3 is a bottom view of the valve of FIG. 1.

In FIG. 3, it can be seen that the cylindrical portion 12 has a hollow interior 28. It is to be understood that the valve member 2 according to the invention is made of flexible material which is air-tight and water-tight, such as cast soft rubber, and preferably, it is molded or cast so that it principally comprises, apart from the bushing member 20, a single integral piece which is, except in the vicinity of the bottom wall 24 and the cylindrical collar member 18, relatively thin-walled and flexible.

It will be evident to those skilled in the art how a valve member 2 of the kind described above may be installed and used, cooperating with a suitable seat member in the vicinity of the bottom of the flush tank to provide a satisfactory valving action; it will be understood that the valve-seat member with which the valve 2 of the invention is used will consist of or contain an appropriately flared or tapered frustroconical section which is adapted to be engaged by the protuberances 6 and 8 and the surface 4. Moreover, in accordance with the teachings of the present invention, there is obtained towards the end of each flushing action, because of the thin-walled flexible nature of the valve 2 and the downward rush of water from the flush tank into the toilet bowl, a partial vacuum within the hollow interior of the valve member 2, with the result that there is thus obtained a downward thrust action which tends to accelerate the closing of the valve, with a water-saving effect, and to ensure the development of a desired seal.

While I have shown and described herein a certain embodiment of my invention, I intend to cover as well any change or modification therein which may be made without departing from its spirit and scope.

I claim as my invention:

1. A water-closet valve which is principally hollow and thin-walled and made of flexible material, being open at its bottom, said valve having means including an internally-threaded inflexible bushing member snugly received within a collar member integrally formed on the top of said valve for connecting it to a vertically-extending rod-like operating member, said valve being adapted to be received by an open-bottom valve seat member having a frustroconical surface which tapers inwardly toward its bottom, said valve having an exterior frustroconical surface adapted to engage with said frustroconical surface of said seat member and in said exterior frustroconical surface first and second circumferential protuberances effective to create by engagement with said seat member a double-seal action said valve being imperforate and capable of developing within its interior during the downward rush of water from a flush tank to toilet bowl a partial vacuum in its hollow interior which generates a downward thrust action to accelerate the closing of an exterior frustroconical surface of said valve against said frustroconical surface of said seat member to obtain a water-saving effect.

2. A valve as defined in claim 1, wherein said valve is made of cast soft rubber.

3. A valve as defined in claim 1, wherein said inflexible bushing member is made of metal.

* * * * *